United States Patent [19]

Carranza

[11] Patent Number: 4,627,546

[45] Date of Patent: Dec. 9, 1986

[54] FLEXIBLE DETACHABLE HANDLE AND CARRIER FOR A PLASTIC BOTTLE AND THE COMBINATION THEREOF

[75] Inventor: Jose R. Carranza, San Francisco, Calif.

[73] Assignee: Merrick Industries, Sunnyvale, Calif.

[21] Appl. No.: 579,243

[22] Filed: Feb. 13, 1984

Related U.S. Application Data

[63] Continuation-in-part of Ser. No. 425,353, Sep. 28, 1982, abandoned.

[51] Int. Cl.[4] ..... B65D 23/10

[52] U.S. Cl. ..... 215/100 A; 220/85 H; 220/94 R; 294/27.1; 294/31.2; 294/33

[58] Field of Search ..... 215/100 A, 100 R; 294/27 R, 27 H, 31.2, 33, 170, 27.1; 220/85 H, 94 R; 224/148; 206/148

[56] References Cited

U.S. PATENT DOCUMENTS

| | | | |
|---|---|---|---|
| 2,070,414 | 2/1937 | Snell | 215/100 A X |
| 2,617,676 | 11/1952 | Kinney, Jr. | 294/31.2 |
| 3,086,806 | 4/1963 | McAndrew | 215/100 A X |
| 3,116,947 | 1/1964 | Brownrigg | 215/100 A X |
| 3,177,025 | 4/1965 | Short | 215/100 A X |
| 3,186,544 | 6/1965 | Curry et al. | 215/100 A X |
| 3,220,626 | 11/1965 | Tupper | 294/31.2 X |
| 3,311,252 | 3/1967 | Swartwood et al. | 215/100 A |
| 3,463,536 | 8/1969 | Updegraff et al. | 215/100 A X |
| 3,682,352 | 8/1972 | Doucette | 294/31.2 X |
| 4,207,997 | 6/1980 | Croyle | 294/31.2 X |
| 4,379,578 | 4/1983 | Schuler | 215/100 A X |
| 4,453,630 | 6/1984 | Helms et al. | 206/148 X |

FOREIGN PATENT DOCUMENTS

| | | | |
|---|---|---|---|
| 706243 | 3/1965 | Canada | 206/148 |
| 2128993 | 1/1973 | Fed. Rep. of Germany | 215/100 A |
| 2322478 | 11/1974 | Fed. Rep. of Germany | 215/100 A |
| 911277 | 11/1962 | United Kingdom | 294/31.2 |
| 919799 | 2/1963 | United Kingdom | 215/100 A |

*Primary Examiner*—William Price
*Assistant Examiner*—Sue A. Weaver
*Attorney, Agent, or Firm*—Thomas S. MacDonald; Alan H. MacPherson; Steven F. Caserza

[57] ABSTRACT

A handle for use in carrying and pouring from a plastic bottle comprises a single two-ended piece of flat flexible material possessing at one end means for attachment to a bottle neck and at the other end means for attachment to the bottle bottom. Between the two ends of material is formed a hand hold. The handle attaches to the bottle neck by use of two partially overlapping, nonconcentric openings the first of which slips over the bottle neck and collar and the second of which then snaps around the neck when the handle is tugged. The bottom employs a pair of integral stabilizing tabs extending inwardly of a bottle encompassing ring which upon insertion over the top of the bottle and movement downwardly over the bottle periphery extend both upwardly or one upwardly and one downwardly with respect to the ring, thus firmly gripping a lower part of the bottle. The tabs in the preferred embodiment extend from the ring a distance greater than one-half the diameter of the ring and cover a relative large area so that their footprint on the bottle follows the inward partial collapse of the bottle walls and continues in engagement with the bottom walls as the bottle is emptied.

4 Claims, 6 Drawing Figures

FLEXIBLE DETACHABLE HANDLE AND CARRIER FOR A PLASTIC BOTTLE AND THE COMBINATION THEREOF

CROSS-REFERENCE TO RELATED APPLICATION

This application is a continuation-in-part of U.S. Ser. No. 06-425,353 filed 9/28/82, now abandoned. Benefit of the filing date for common subject matter is claimed. The contents of Ser. No. 425,353 are herein incorporated by reference.

FIELD OF THE INVENTION

This invention relates to detachable handles for plastic bottles of the soft drink bottle type and in particular to handles for use in carrying and pouring liquids from such bottles which are capable of being inexpensively produced in a flat configuration, making them easy to store, and which in use impart rigidity to such bottles.

DESCRIPTION OF THE PRIOR ART

Soft drinks are often sold in large two liter plastic bottles. Being made of a thin plastic material, each of these bottles contains a large amount of drink while being of relatively low weight. Use of thin plastic has certain drawbacks. For instance, when the container is almost full of liquid, it is very difficult to pour liquid from it into cups because the thin plastic container collapes upon grasping, and either causes the bottle to slip from the hand or forces liquid out of the bottle resulting in a spill. Without a handle, it is usually necessary to use two hands to pour from a full bottle. This leaves no way of steadying the cup to prevent the cup from toppling while being filled. A hard plastic handle that grips the neck or collar of the bottle and extends at an angle from the bottle has been used to solve this problem. With such a handle the bottle can be poured using one hand. This prior art handle typically is made of stiff heavy plastic and is attached to the bottle by a slotted channel at the end of the handle that flexes as the handle is pushed onto the neck or collar of the bottle. Unfortunately, this handle is expensive, being made of hard, heavy duty plastic, requires expensive tooling, a lot of plastic and is not flexible, compact or easily stored. Importantly, this handle attaches to the bottle only at the neck, thereby allowing the bottle to bend relative to the handle while pouring. In certain situations, the handle might even slip from the neck of the bottle while pouring. Other prior art includes a rack-with-handle apparatus. This handle is also made of expensive plastic, must be assembled, lacks flexibility and is not compact and is therefore difficult to store or ship.

U.S. Pat. No. 3,630,477 issued to Stadler discloses a structure which is not a handle but is useful in supporting or hanging bottles, specifically transfusion bottles, in an inverted position. The Stadler structure is not designed for pouring, carrying or handling bottles nor will its design permit hanging a bottle in any but an inverted position.

Handles designed for carrying bottles or containers are disclosed in for example, U.S. Pat. Nos. Des. 256,649, 3,463,536, 3,612,595, 3,679,253, 3,807,679, 3,820,695, 3,963,206, 3,964,126, 4,309,008. None of the structures disclosed in these patents appear useful for pouring liquid from the plastic two liter soft drink container or similar bottle. U.S. Pat. Nos. 4,379,578 and 3,166,947, German Pat. No. 2,128,993 and British Pat. No. 911,277 are also examples of handles for carrying bottles.

SUMMARY

According to the present invention, there is provided a lightweight, flexible and compact handle for use in pouring liquid from large plastic bottles, and particularly from the two (2) liter plastic bottle commonly used to hold soft drinks. As a feature of this invention, the handle can be stamped out of a sheet of material or injection molded. This handle can be made of flexible plastic, paperboard, leather, rubber or even metal or some combination thereof, but preferably is made of flexible plastic. The handle advantageously is of one-piece construction, with no assembly of parts required. The handle is reusable and supports the bottle by attaching both to its bottom and top. Although both the bottle and the handle are each individually flexible, the handle and bottle together form a surprisingly rigid combination. The flexible handle includes means (such as a socket) for snapping on to the top of the bottle and means (such as a harness) for strapping onto the bottom of the bottle.

The handle of this invention is flat and compact and can be stored flat with other handles or by hanging on a hook. The handles can be shipped flat or partially attached to bottles without significant enlargement of the packing cartons. Although the handle is stored flat or two-dimensionally, when attached to a bottle the handle takes on a three-dimensional configuration. Because of this three-dimensional configuration, the handle, when in use, holds the bottle much more securely than would be expected. The handle of the present invention provides an easy, comfortable way to carry more securely than would be expected. The handle of the present invention provides an easy, comfortable way to carry more than one large plastic bottle in each hand. Because the handle is removable and re-usable, it can be used to make a soft drink bottle of the appropriate size into a container for carrying any liquid or into a pitcher for watering plants. The handle can be used as a strap for hanging a bottle, for instance, to a bicycle frame or pipe, for ease in transportation. Retail merchants can shrink-wrap or otherwise bind two or more bottles together and offer a single handle, using this invention, attached to one bottle as a convenient carrier for the group of bottles.

In accordance with this invention, a lightweight, flexible handle is provided which attaches to the plastic bottle at two points—the neck and the lower portion of the bottle. The handle is of such a length as to form a curved member extending from the neck to the lower portion of the bottle and is separated from the bottle at all other points. The separation is sufficiently great to provide space for four fingers of one hand to fit while grasping the handle. The curved portion of the handle is grasped with one hand when the bottle is to be lifted or poured, leaving the other hand free to hold a cup. The curved member, although flexible, provides, when attached to the neck and bottom of the bottle, in combination with the bottle, a relatively rigid handle for safely pouring liquid from the bottle.

Two-liter plastic bottles when completely full are quite rigid despite a lightweight thin plastic wall construction. However when the bottle is opened and as the fluid level in the bottle decreases the walls become appreciably less rigid. When physically grasped either by hand or by a handle the side wall collapses internally squeezing the remaining contents even to the extent of having the fluid contents erupt and spill out an open top. The present invention incorporates a pair of intersecting circular apertures at one end of a flat flexible plastic blank for attachment to a bottle neck and an integral ring portion at the other end having two relatively wide, flexible, elongated tabs extending inwardly of the ring portion. The tabs are in-line with an integral handle portion extending between the bottle neck-holding end and the ring portion end. The tabs on the ring portion are flexed preferably upwardly facing the bottle cap and the ring and tabs slid onto the bottle circumference into a position in which the tabs are aligned parallel to the bottle wall. The bottle-neck end is attached over the bottle neck and the ring moved further downward to result in a preferred loop of the handle holding portion. The tabs firmly grasp the bottle wall and have a footprint over an area of the wall of sufficient size that the wall does not overly bulge inwardly as the ring is fitted or the bottle empties during or after pouring of the fluid contents. At the same time the tabs follow the bulge and continue in holding engagement with the bottle wall.

This invention will be more fully understood in conjunction with the following detailed description taken together with the attached drawings.

DETAILED DESCRIPTION

Figure 1A:
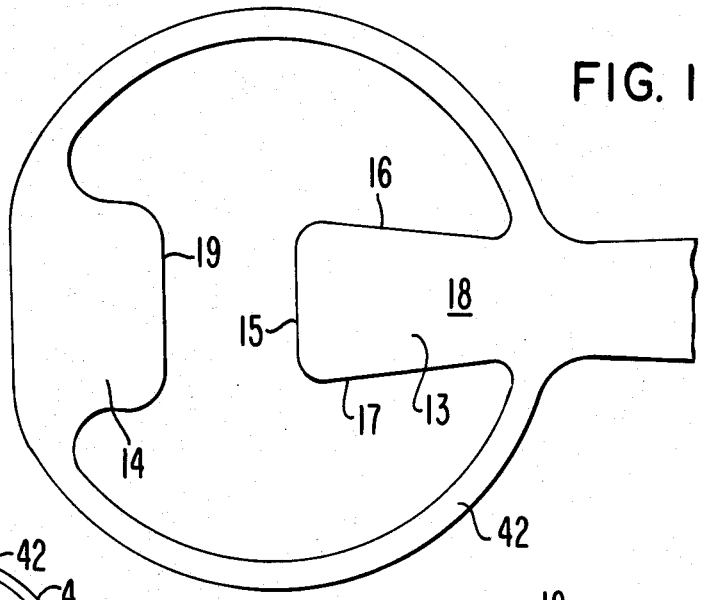
FIG. 1A is a more detailed view of the ring and tab structure.

The following description is meant to be illustrative only and is not intended to limit the scope of this invention which is defined solely by the attached claims. As shown in FIG. 1, the handle 10 of this invention comprises four basic segments—neck grip means 1, hand grip portion 2, connecting structure 3, and bottom grip means 4.

Neck grip means 1 comprises a socket arrangement consisting of two partially overlapping nonconcentric, circular or oval holes (or openings) 11 and 12. Hole 12 is of a diameter such that it will fit snuggly around the neck of the plastic bottle. Such a diameter is typically 1 1/16 or 1 inch for two liter bottles. Larger hole 11 is sized so that the material surrounding hole 11 will easily and unobstructedly fit over the cap and collar of the plastic bottle; such an opening is typically about 1⅝ inch or 1 5/16 inch in diameter for a two liter plastic bottle. Hole 11 is not necessarily circular, but can be elliptical, oval or other shape. The tabs 12*a* and 12*b* between and directly adjacent to the two circular holes are separated by approximately 1 inch in dimension "$d_1$", thereby allowing the material surrounding smaller hole 12 to be snapped around the bottle neck in a double acting deflection action wherein the neck of the bottle acts as a cam to drive tabs 12*a* and 12*b* apart as these tabs are slid past the neck. Tabs 12*a* and 12*b* resume their original position as shown once the neck of the bottle is centered in opening 12. Opening 11 also provides a finger hold for installing and removing the handle of this invention.

Neck grip means 1 is attached to hand grip 2 by tapered neck-downed integral interconnect area 1*a*. Hand grip 2, in one embodiment, is approximately 4¾ inches long, 3/32 inches thick, and has a width of approximately ½ inch. Hand grip 2 is preferably formed with crenelated finger grip edges 2*b* and 2*c* rather than straight edges. Hand grip 2 can also be serrated along one face (preferably the face facing away from the bottle) to provide a non-slip grip. The flat face of the hand grip 2 can be used for advertising or identification through appropriate lettering, or the handle can be colored or shaped for appropriate advertising.

The end of hand grip 2 opposite neck grip means 1 extends to form an integral grip means 4 for holding and gripping the bottom of the bottle. This grip portion of the handle 10 comprises a generally triangular segment forming tab 13 and a ring 42 from which extends a reentrant tab 14 facing tab 13. Ring 42 is part of the bottle-bottom grip means 4. Tabs 13 and 14 extend inwardly from ring 42 in-line with handle grip 2. In order to provide sufficient footprint on the thin-walled bottle walls the tabs collectively in the preferred embodiment extend over at least one-half of the inner diameter of ring 42, tab 13 being radially longer than tab 14. Tab 14 is wider than tab 13 since in use it supports most of the weight of the bottle 28 and its contents.

Figure 1:
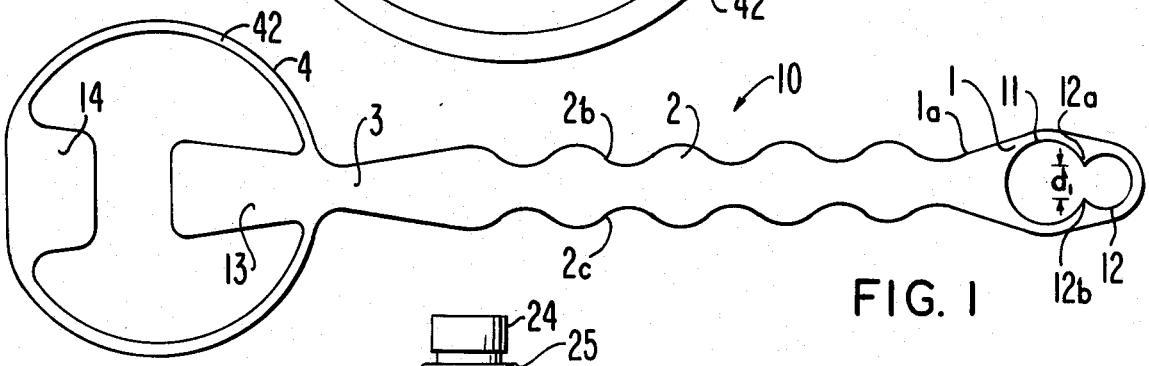
FIG. 1 is a top view of the preferred embodiment of the bottle holder.
Figure 2:
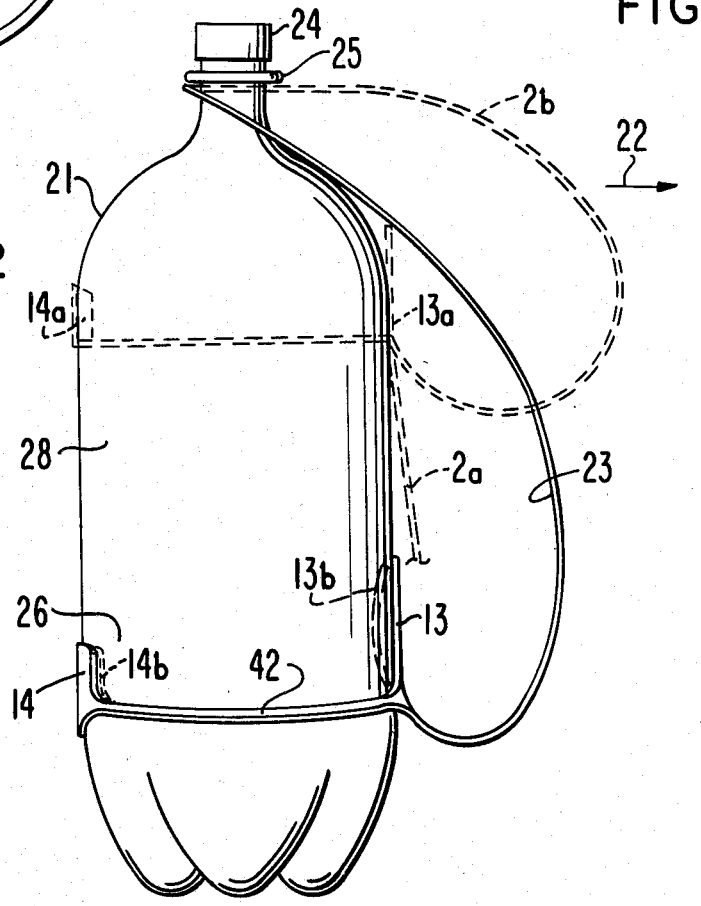
FIG. 2 shows a side view of the preferred embodiment of the invention utilizing stabilizing tabs on a ring twistable to hold the lower portion of a bottle.

FIG. 1A shows the tabs and ring in approximately ¾ of full size. Tab 13 has a cantilevered outside edge 15 which extends just short of the center of ring 42. Tab 13 has angular side edges 16, 17 and a narrower base portion 18 allowing for ease of deflection in fitting the ring and tabs over the bottle sides. Tab 14 is of generally rectangular configuration with a cantilevered outside edge 19 parallel to edge 15 of tab 13. Edge 19 is of sufficient width so that in bottle-holding mode it results in a relatively large footprint of tab 14 on the curved bottle sides. The ring and associated tabs of the holder are preferably applied to the bottle by facing the neck-holding means 1 downwardly and then sliding ring 42 over the top of the bottle at its neck with tabs 13 and 14 twisted or bent to extend upwardly as shown in FIG. 2 to a position shown in dotted lines 13*a*, 14*a*—just below the beginning of the maximum bottle diameter i.e. below the inward conical bottle flare 21 leading to the neck. The hand grip portion 2 and grip means 1 extends downwardly in dotted position 2*a* and is then lifted from dotted position 2*a* outwardly and upwardly i.e. bent, until the large neck aperture 11 slips over the bottle cap 24 and any neck ridge 25 to a desired position on the bottle neck at dotted position 2*b*. The hand hold is then pulled outwardly in the direction of arrow 22 to place the smaller aperture 12 in tight fitting grip of the bottle neck and held in place by tabs 12*a*, 12*b*. The ring 42 which is slightly twisted is then moved downwardly closer to a bottom position on the bottle side walls 26 as shown in full lines so that aperture 12 is taut on the bottle neck and hand grip portion 2 still has a sufficient loop 23 so that the fingers of one's hand can be placed therein for carrying or pouring. Outer ring 42 possesses an inner diameter approximately ⅛ inch larger than the diameter of the plastic bottle for which the holder is to be used, nominally 4¼ inches for a 2-liter bottle.

FIG. 2 also shows how tab 13 follows an inward partial collapse of the thin wall bottle 28 as it loses its inner fluid support as and after the fluid is poured from the bottle i.e. the bottle is partially emptied. Tab 13 follows the inward bulging or collapse of the bottle sides to a position shown by dotted position 13*b*. It continues in engagement with the bottle wall during and after that wall collapse due to twist of the flexible tab at its root portion with ring 42. The twist and hinge-like movement of tab 13 exerts a force in the direction of returning tab 13 to a neutral position across the diameter of the ring 42. A similar action occurs with respect to tab 14 where tab 14 moves to dotted position 14*b* upon the bottle emptying. The relative large sized area or footprint of the tabs 13, 14 prevents puncturing or creasing of the thin bottle wall. Large sized tab area as used herein for 2-liter bottles means tab total areas of substantially 2 square inches or more. In the preferred embodiment the tab 13 has an area of about 1.25 $in^2$ and tab 14 an area of about 1.50 $in^2$.

The firm grip on the bottom of the bottle by bottom grip means 4 coupled with the firm grip on the neck of the bottle achieved through use of neck grip means 1 results in a convenient, firm holder for large plastic bottles even though the handle and the bottle are each flexible when alone. The dimensions of the handle 10 of FIG. 1 can be adjusted to fit any bottle, plastic or otherwise.

An embodiment of the handle of this invention suitable for use with a standard two liter plastic bottle, is approximately 14⅝ inches long, and 3/32 inches thick. Because the handle of the present invention is relatively thin, it is easily stored. In fact, should the holder be sold with or stored attached to the plastic bottle, the holder would only increase the diameter of the cylindrical portion of the plastic bottle by twice the thickness of the plastic, which is 3/32 inch in the preferred embodiment. Another advantage of the holder of the present invention is that it can be used not only for pouring, but also for carrying the plastic bottles. More than one bottle can easily be carried in each hand using the handle of this invention. Two or more bottles shrink-wrapped or connected together can be carried using one handle of this invention. Thus the handle of this invention provides a convenient method of carrying one or more bottles.

In the use of the present invention tabs 12*a* and 12*b* at the intersection of the apertures 11 and 12 pass in a cam action past the, neck of the bottle and thus fit the material surrounding the smaller diameter hole 12 tightly around the neck of bottle. The bottle 28 can then be lifted using the handle and poured using one hand or carried. The result is a securely held bottle.

Figure 3:
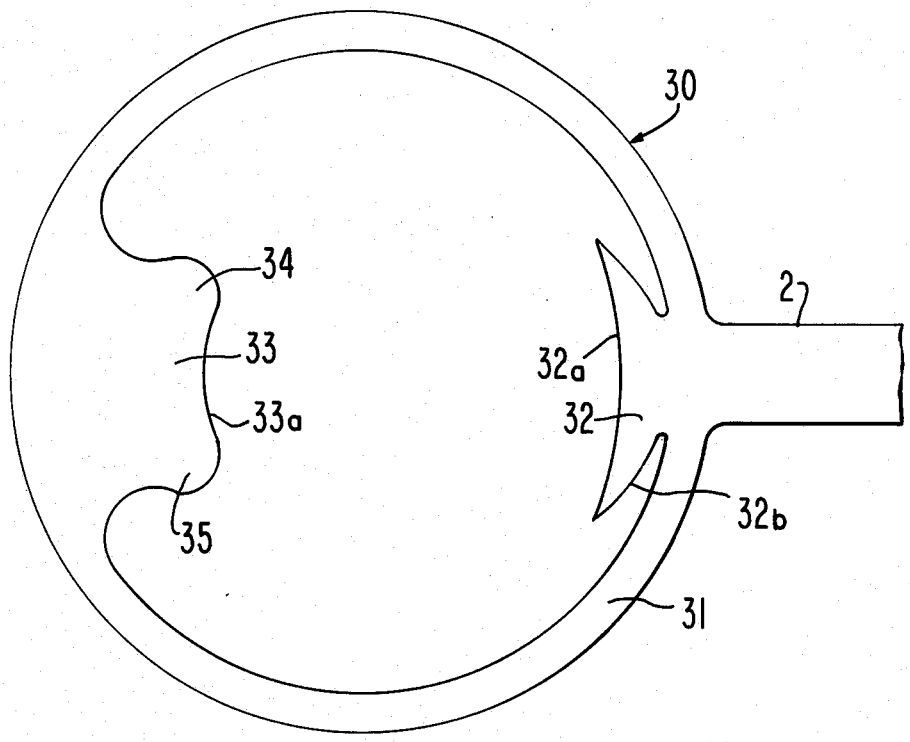
FIG. 3 is a partial top view of a further embodiment of a tabs-containing bottle holder.
Figure 4:
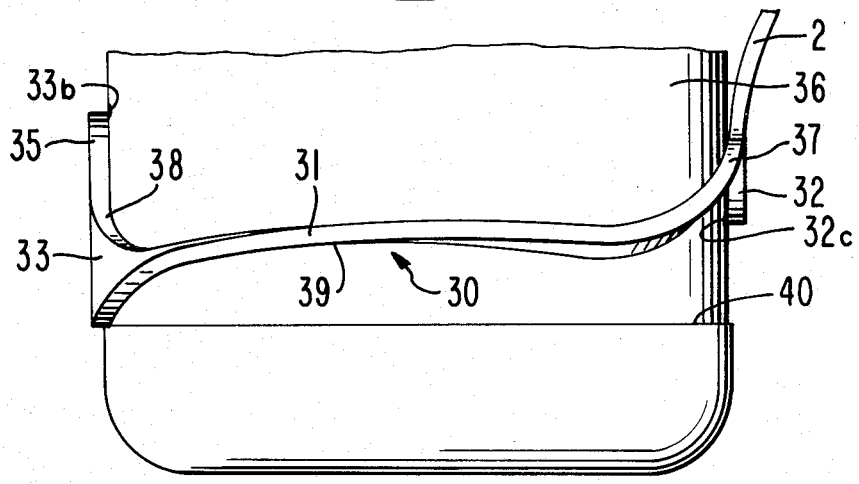
FIG. 4 is a side view of the device of FIG. 3 showing the stabilizing tabs in bottle-mounted position.
Figure 5:
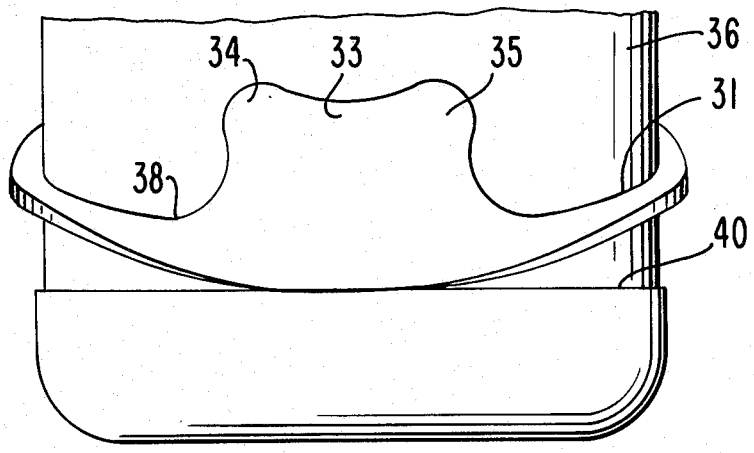
FIG. 5 is a rear view of the device of FIG. 3 showing the outboard tab in bottle-holding mode.

Another embodiment of the structure to attach the strap to the lower part of a bottle is seen in FIGS. 3–5. An integral flexible blank has ring means 30, for attaching the strap to the lower part of a bottle, extending from the hand hold section 2, previously described. Ring means 30 in the FIG. 3 non-bottle mounted position comprises a relatively thin (¼ inch wide—3/32 or ⅛ inch thick) flexible plastic ring 31 having an outer diameter of 4⅝ inches when used with a two-liter bottle and typically stamped from polyethylene sheet or molded from plastic powder or crystals. Ring 31 which may be a true circle or elliptical has at least one but preferably two stabilizing tab means 32 and 33 extending inwardly from the ring in its flat blank non-bottle mounted mode. Tab 32 is adjacent to, extends outwardly from, and is in line with portion 2. Tab 32 has a generally triangular configuration in its flat stamped-out form with an initial bottle conforming curved edge 32*a* and curved side edges 32*b*. A second stabilizing tab 33 extends inwardly of ring 31 at its outer extremity in a non-bottle mounted mode and at a position diametrically opposed to tab 32. Tab 33 has a curved surface 33*a* conforming to the curve of a bottle surface and two lobes 34 and 35 extending on either side of curved edge 33*a*. An edge of curved surfaces 32*a* and 33*a* in bottle-carrying mode firmly grips the bottle actually indenting or deforming the thin bottle sides slightly as shown at 32*c* and 33*b*. The outside facing areas of tab 33 may be employed as a site for additional advertising or marking. The overall strap has a length of 15¼ inches when used for a two-liter soft drink bottle. It can, of course, be made in varying sizes.

FIG. 4 shows ring means 30 mounted on and encompassing a lower part of a bottle 36 in the bottle-mounted mode. The ring 31 of the overall strap is mounted over the top of the bottle and pulled down to a lower position normally adjacent to the bottle bottom. Tab 32 is maneuvered by hand or mounting machine to extend downwardly front point 37 and to slide down one vertical side of the bottle to a position parallel to the bottle side. Tab 33 is maneuvered by hand or mounting machine to extend upwardly and to slide down the other vertical side of the periphery of the bottle to a position parallel to the bottle side. This action is encouraged by lifting the hand hold section and bottle neck-holding end upwardly of the bottle top which orients tab 32 downwardly. Pushing down on the sides of the ring 31 adjacent to both sides of tabs 32 and 33 moves the ring to its desired position. By this 17 action and the natural twisting of ring 31 sliding down over the curved top of the bottle (the bottle having an increasing diameter from its top spout to a more midportion) forces tab 33 to take an upward facing position. Tab 33 is twisted or bent upwardly from point 38. The bottom of tab 33 generally is moved downwardly to rest on a ridge 40 formed in, or the top of a bottom cap placed on, the bottle bottom of the typical two-liter thin plastic bottle made by the so-called blow mold process. In order to have tabs 32 and 33 reach their respective down-up bottle-conforming positions, ring 31 is twisted as at 39, 180° along its length, firmly gripping the bottle.

FIG. 5 shows a rear view of tab 33 showing its footprint on the bottle 36 conforming to the area bounded by an upward vertical distance of the bottle from ring 31 to the extremity of tab 33 and to the lateral curvature of the bottle over that vertical distance covered by lobes 34, 35.

The handle of this invention has numerous advantages over the prior art handles. It can be formed into a flat, inexpensive configuration from plastic by stamping or molding, and thus can be shipped and stored flat and compactly thereby saving substantial costs. Although flexible, the handle, when attached at both ends to the neck and bottom of a plastic bottle, provides a combined bottle-handle system which is relatively stiff and rigid thereby providing a firm support for pouring. The handle can be shipped with the bottle without substantially increasing the bulk associated with the bottle and thus without substantially raising shipping or crating costs. Finally, the handle has sufficient area to allow the imprinting of advertising or other messages on an easily visible portion of the handle.

While several embodiments of this invention have been described, other embodiments will be obvious to those skilled in the art in view of the above disclosures. The above description is meant to be illustrative only and not limiting.

I claim:

1. Structure for use in carrying and pouring from a plastic bottle having a narrowed neck and a cylindrical bottle bottom of greater diameter than said neck, comprising an integral two-ended piece of flat flexible material comprising:

means at one end thereof for attachment to a bottle neck;

means at the other end thereof for attachment to a bottle bottom; and means, between said one end and said other end, for providing a hand hold thereby to enable a user to carry or pour from any bottle attached to said structure, wherein said means for attachment to said bottle bottom comprises a flexible and twistable ring having an inner diameter larger than the outer diameter of the bottle bottom to which it is to be attached and adapted to be fitted around the circumference of a lower portion of a bottle below the bottle neck in a bottle-holding mode; and in which said flexible ring is circular and has a pair of stabilizing tabs each extending inwardly for different lengths at opposed diametrical positions of said ring, in-line with said hand hold means and said bottle neck attachment means, said ring and said tabs in bottle-mounted position being twisted from said in-line position to surround said bottle bottom and to extend parallel to vertical sides of said bottle bottom, respectively.

2. A plastic carrying and pouring strap for a thin plastic, liquid-containing, cylindrical bottle comprising an integral flexible flat plastic blank having first ring means at one end for removable attachment and affixation to a bottle neck;

second ring means at the other end of said blank and including a circular ring of a diameter just greater than the diameter of a bottle bottom, said bottle bottom diameter being greater than the diameter of said neck for removable attachment and holding to said bottle bottom and means between said first and second ring means for providing a hand hold when said blank is attached to said bottle to enable a user to carry or pour from said bottle;

said second ring means further including a single pair of stabilizing tabs, each tab extending inwardly from said circular ring at opposed diametrical positions in non-bottle mounted position of said blank in-line with said hand hold means and wherein said circular ring and said tabs are twistable to conform to a vertical surface of said bottle bottom in the bottle-mounted position to firmly hold said blank on said bottle.

3. Structure as in claim 2 in which said second ring means is inserted over the bottle neck onto said vertical surface and said means for providing a hand hold is looped upwardly from said bottle vertical surface to attach said first ring means to said bottle neck.

4. Structure for use in carrying and pouring from a plastic bottle, comprising an integral two-ended piece of flat flexible material comprising:

means at one end thereof for attachment to a bottle neck;

means at the other end thereof for attachment to the bottle bottom; and, means, between said one end and said other end, for providing a hand hold thereby to enable a user to carry or pour from any bottle attached to said structure, wherein said means for attachment to said bottle bottom comprises a flexible ring having an inner diameter larger than the outer diameter of the bottle bottom to which it is to be attached and adapted to be fitted around the circumference of a lower portion of a bottle below the bottle neck in the bottle-holding mode;

in which said flexible ring has a pair of stabilizing tabs extending inwardly at opposed diametrical positions of said ring in-line with said hand hold means and said bottle neck attachment means, said ring and said tabs in bottle-mounted position being twisted from said in-line position to surround said bottle bottom and to extend parallel to vertical sides of said bottle bottom, respectively, and in which one tab has a dual-lobed configuration and extends in mounted portion upwardly of said bottle, and the other tab is of generally triangular configuration and extends in mounted position downwardly of said bottle away from said hand hold means.

* * * * *